United States Patent [19]

Kennedy

[11] Patent Number: 4,711,582

[45] Date of Patent: Dec. 8, 1987

[54] ROTARY MIXING OF TWO COMPONENT RESINS IN DISPOSABLE PLASTIC BAG

[76] Inventor: Richard B. Kennedy, 519 Branchville Rd., Ridgefield, Conn. 06877

[21] Appl. No.: 928,058

[22] Filed: Nov. 7, 1986

[51] Int. Cl.[4] ..... B01F 9/00

[52] U.S. Cl. ..... 366/279; 366/65; 366/189; 366/251

[58] Field of Search ..... 366/244, 245, 247, 248, 366/249, 251, 279, 65, 184, 189, 194, 348, 349

[56] References Cited

U.S. PATENT DOCUMENTS

| | | | |
|---|---|---|---|
| 1,742,878 | 1/1930 | Rosenberg | 366/249 |
| 2,515,555 | 7/1950 | Gratias | 366/279 |
| 2,717,147 | 9/1955 | Fejmert et al. | 366/65 |
| 3,030,081 | 4/1962 | Wilson et al. | 366/348 |
| 3,081,983 | 3/1963 | Thibodeaux | 366/65 |
| 3,819,158 | 6/1974 | Sharpe et al. | 366/349 |
| 4,592,657 | 6/1986 | Taubenmann | 366/189 |

*Primary Examiner*—Timothy F. Simone
*Assistant Examiner*—Corinne Reinckens
*Attorney, Agent, or Firm*—Eric P. Schellin

[57] ABSTRACT

A mixing device and method wherein liquids are rotatingly mixed in a disposable plastic bag mounted in and outer receptacle. The bag is provided with extending portions which overlap the open top of the outer receptacle. The interior sidewalls of the outer receptacle are inwardly sloping defining a truncated conical interior. When the bag is filled with liquid to be mixed the bag conforms to the sidewalls and does not twist around a rotating mixing element disposed through the open tops of the bag and outer receptable for mixing the contents of the bag. The mixing element is centered in the bag by a cap-like cylindrical structure that engages the top of the outer receptacle.

19 Claims, 3 Drawing Figures

ROTARY MIXING OF TWO COMPONENT RESINS IN DISPOSABLE PLASTIC BAG

FIELD OF THE INVENTION

The invention is directed to a method of and means for mixing at least two components, wherein one is liquid, in a disposable plastic bag by a rotary mixing element.

DESCRIPTION OF THE PRIOR ART

There are presently a wide number of uses of two-component elastomer foams. With these foams two separate components must be mixed together a short time before application as they are fast setting. The Dow Corning Corporation and General Electric Corporation currently market such foams, that are used as fire stops in utility races. In one system the two components are stored in a cartridge and separated by a membrane that is ruptured when mixing is to occur. A mixing element is then reciprocated back and forth through the cartridge mixing the contents After mixing, a plunger is forced through the cartridge dispensing the contents through a dispensing nozzle. This system results in incomplete mixing because the components are relatively viscous. In another relatively more complicated and expensive delivery system the components are combined at a dispensing nozzle by a pneumatically operated air gun. The components are impinged against one another, thereby resulting in more complete mixing before being dispensed from the gun. Typically the pneumatically operated air gun system is used for large installations and the cartridge system is used for small installations.

It is well known to mix components by rotating mixing element that contacts the components in a container. Typically the rotating mixing element is centered in the container so that it does not contact the sides of the container which could result in damaging the container or mixing element. Examples of similar mixing assemblies are disclosed in U.S. Pat. Nos. 2,766,022 and 4,561,782.

In mixing components it is desirable to mix the components in a disposable container. A disposable mixing device disclosed in U.S. Pat. No. 3,603,564, comprises a cylindrically shaped disposal container having a top through which a rotary mixing element is positioned for mixing the contents. The bottom of the container is frangible and forms a plunger, when detached, for forcing the contents from the container. Plastic bags are well suited as disposable mixing containers. Typically a plastic bag and its contents is kneaded thereby mixing the components contained therein. Such mixing devices are disclosed in U.S. Pat. Nos. 3,030,081, and 3,819,158. However the use of rotary mixing element with disposable plastic bags has not proved as satisfactory because the bag tends to become entangled with the rotary mixing element. More specifically the swirling action of the rotary mixing element causes twisting of the bag resulting in the bag becoming entangled on the mixing element.

SUMMARY

The present invention is directed to the rotation mixing of a liquid in an opened topped disposable plastic bag. The plastic bag is fitted into an open topped outer receptacle having inwardly sloping interior sidewalls. After a liquid is placed in the bag, the bag expands, so that its sidewalls contact the sidewalls of the outer receptacle. A rotary mixing means is then inserted into the liquid contained in the bag and centered therein by a centering means. As the rotary mixing element of the rotary mixing means is rotated the bag does not twist around the mixing element because of the adhesion and surface friction between the sidewalls of the receptacle and the sidewalls of the bag.

DETAILED DESCRIPTION

Figure 1:
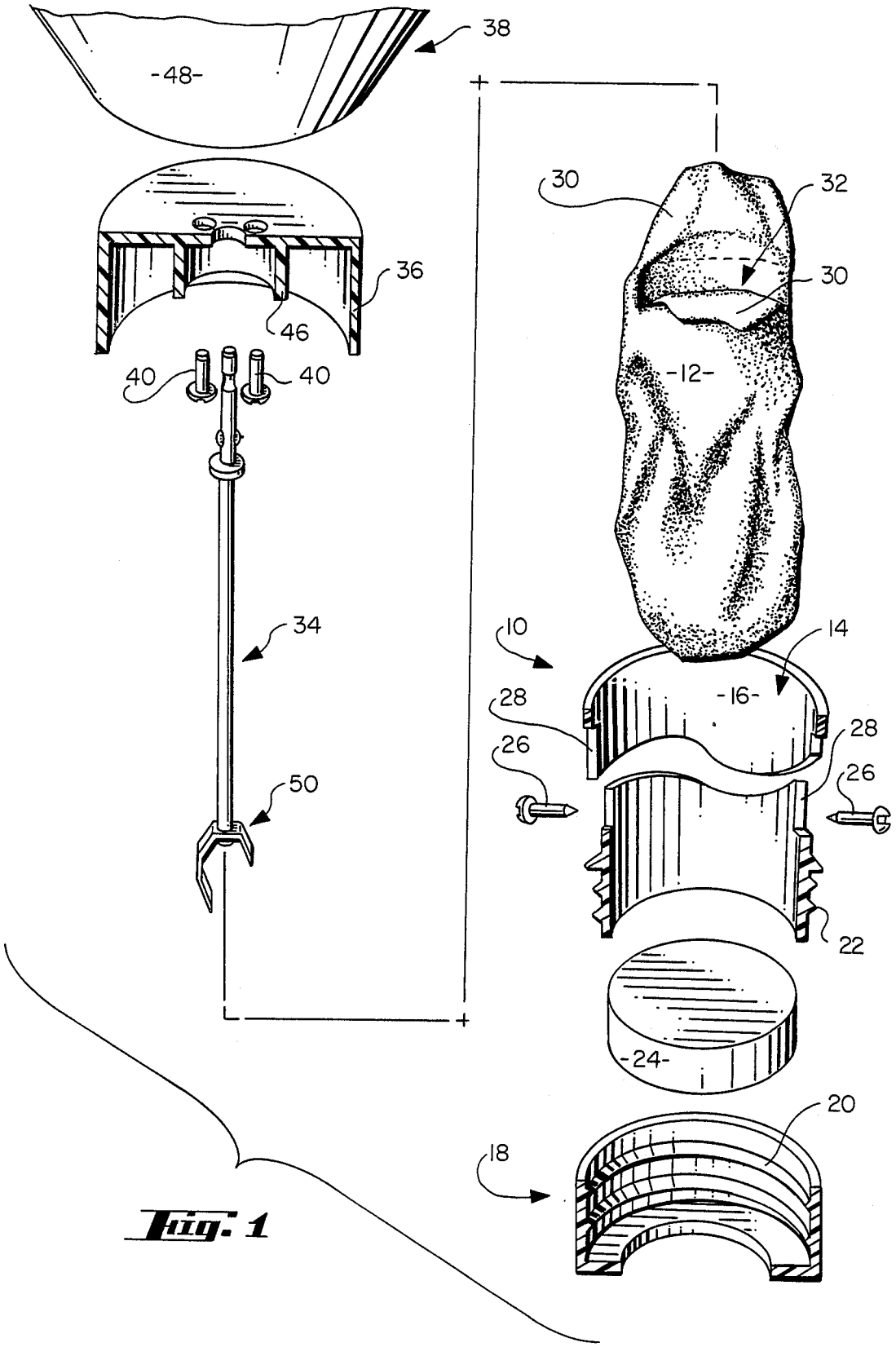
FIG. 1 is an exploded cross sectional view of the mixing assembly.

The present invention comprises outer receptacle 10 into which is nested plastic bag 12. The outer receptacle is generally cylindrically shaped and is provided with open top 14 and inwardly sloping sidewalls 16. Bottom member 18 is provided with internal threads 20 that screwingly engage external threads 22 located at the base of receptacle 10. Bottom member 18 is used to hold slidable plunger 24 in the receptacle. The slidable plunger is adapted to slide up and down in the receptacle and is slidingly secured thereto by screws 26 that are mounted to the plunger. The shafts of the screws are located in longitudinal apertures 28, so that the plunger and can slide up and down.

Disposable plastic bag 12 is used to line the outer receptacle and also provide a disposable reservoir into which components to be mixed can be deposited. The bag is provided with extending portions 30 which are used to overlap the open top of the receptacle. In this way open top 32 of the bag and open top 14 of the receptacle are properly aligned so that the components and be placed into the bag.

One of the key features of the invention is the inwardly sloping interior sidewalls of the outer receptacle. These sidewalls define an interior space in the shape of a truncated cone to which the bag corresponds when filled with the components to be mixed. It has been found that by having the interior sidewalls with an inward slope that the surface friction and adhesion between the receptacle and the bag is increased thereby tending to prevent twisting of the bag when the contents of the bag are rotatingly mixed. One possible explanation of this phenomina is that the bag better conforms to the sidewalls of the receptacle than a conventional bag, because a conventional bag would tend to form a teardrop configuration when filled thereby not entirely engaging the sidewalls of the receptacle.

Figure 2:
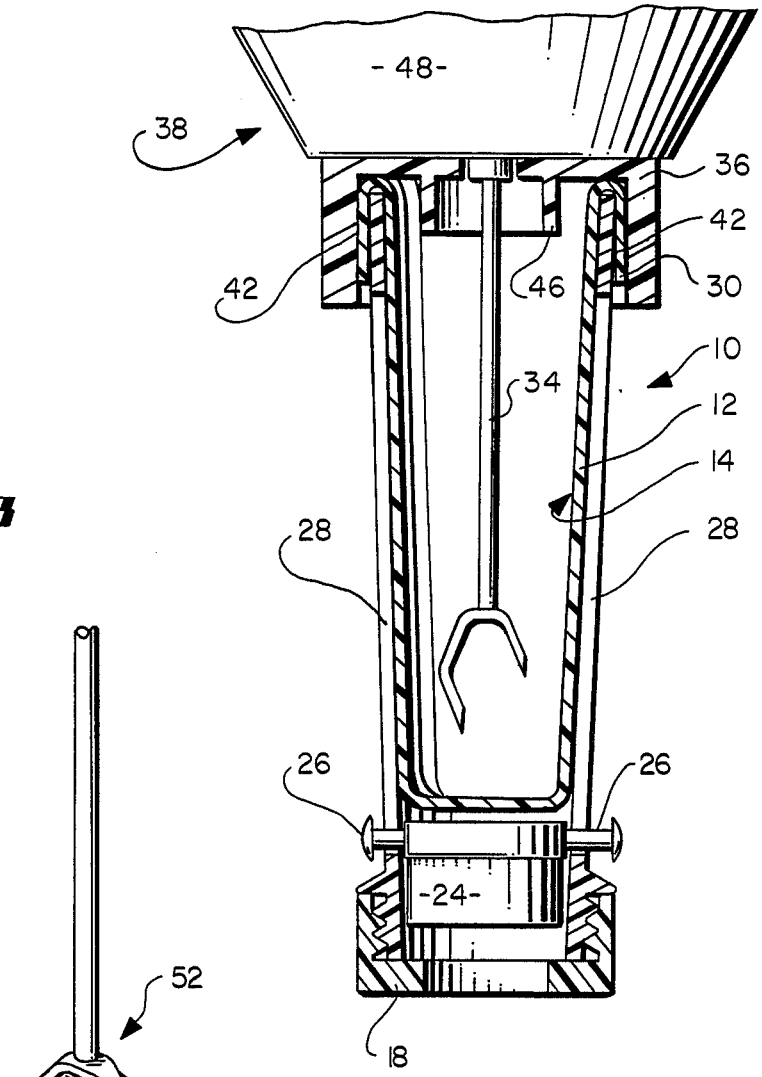
FIG. 2 is a cross sectional view of the assemblied mixing assembly.
Figure 3:
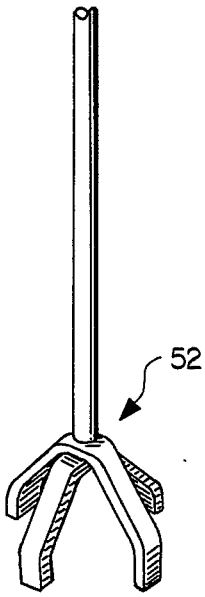
FIG. 3 is a perspective view of an alternate mixing element.

Another important aspect of the invention is the means for centering mixing element 34 in the bag, so that it does not contact the sidewalls of the bag. The centering means itself comprises a cap-like cylindrical structure 36 that is secured to the housing of rotary mixing means 38 by screws 40. As illustrated in FIG. 2, cylindrical structure 36 engages the exterior sidewalls of the bag at the top of the receptacle thereby effectively locking the mixing element in a central vertical axis in the bag. Cylindrical structure 36 also provides sealing surface 42 between the overlapped portion of the bag and the interior wall of cylindrical structure 36. The centering means is provided with second concentric cylindrical structure 46 that has a smaller diameter that the outer structure and can be used for smaller outer receptacles and mixing assemblies.

Rotary mixing means 38 comprises mixing element 34 and electric motor housing 48. The mixing element is detachably released from the electric motor by relatively conventional assemblies that are used in household food mixers. Two alternate tine assemblies 50 and 52 are illustrated in the drawings. Tine assembly 50 comprise two tines each having a different length thereby causing greater turbulence during mixing by adding a downward velocity component due to this uneven structure. Similarly tine assembly 52 is provided with four tines each having a different length.

In use bag 12 is placed into receptacle 10 and bag extension portions 30 are overlapped over the outside edge of the receptacle. Each of the components are then poured into the bag and the bag in turn expands corresponding to the shape of the receptacle. The rotary mixing element 34 is then inserted into the bag and centered therein by the centering means. The mixer is actuated and the mixing element is rotated mixing the contents of the bag. The mixer can them be removed and the contents poured out of the bag. Alternately the plunger can be pressed forward to eject the contents of the bag by gripping the outwardly extending screw heads.

The bag can be made of any suitable liquid resistant film such as plastic. The outer receptacle can also be made of plastic and it is desirable that it is made of a transparent or translucent plastic so that its contents can be monitored. The outer receptacle or bag may also be provided with indicia indicating the volume of the liquid contained therein.

It should be noted that the overall volume of the bag should closely correspond to the internal volume of the outer receptacle. A bag that is too large will cause folds that may become tangled with the rotating mixing element. A bag that is too small may result in insufficient surface contact between the bag and the outer receptacle.

The above described apparatus and method should not be limited by the above description but should be limited solely by the claims that follow.

I claim:

1. An apparatus for mixing and agitating a liquid, the apparatus comprising:

a rigid outer receptacle defining an interior and having an open top, the receptacle is provided with interior sidewalls that have an inwardly sloping configuration; and a flexible and disposable liquid resistant bag having an open top, a closed bottom and sidewalls, the bag is adapted and constructed to line the interior sidewalls of the outer receptacle; when liquid to be mixed is deposited into the bag, the bag expands contacting the sidewalls of the outer receptacle, a mixing element can then be placed through the open tops of the receptacle and the bag for mixing liquid contained in the bag.

2. An apparatus as defined by claim 1 wherein the interior of the outer receptacle comprises a truncated cone with the base of the cone formed by the open top.

3. An apparatus as defined by claim 2 wherein the bag is provided with an extending portion adjacent to the open top of the bag which is adapted and constructed to overlap the open top of the receptacle securing the bag to the receptacle.

4. An apparatus as defined by claim 3 wherein the outer receptacle is provided with a slidable bottom member comprising a plunger for forcing the liquid contents of the bag and receptacle out through their open tops.

5. An apparatus as defined by claim 4 wherein the outer receptacle is provided with indicia for indicating the liquid volume contents of the bag.

6. An apparatus as defined by claim 2 further comprising a rotary mixing means having a mixing element that is adapted and constructed to be positioned through the open tops of the bag and receptacle into liquid contained therein.

7. An apparatus as defined by claim 6 wherein the rotary mixing means is provide with a centering means which cooperates with the outer receptacle to center the mixing element in the interior of the outer receptacle.

8. An apparatus as defined by claim 7 wherein the centering means comprises a cylindrical cap which engages the top of the receptacle to center the rotary mixing element.

9. An apparatus as defined by claim 8 wherein the rotary mixing means further comprises an electric motor which rotates the mixing element.

10. An apparatus as define by claim 9 wherein the centering means comprises at least two nested cylindrical caps having different diameters which are adapted and constructed to engage the tops of different sized outer receptacles.

11. An apparatus as defined by claim 9 wherein the mixing element is provided with at least two downwardly projecting tines of different lengths which are adapted and constructed to extend into and contact liquid contained in the bag and receptacle.

12. An apparatus as defined by claim 9 wherein the mixing element is provided with at least four downwardly projecting tines each having a different length and which are adapted and constructed to extend into and contact liquid contained in the bag and receptacle.

13. An apparatus as defined by claim 9 wherein the bag is formed of a plastic film.

14. A method of mixing at least two components wherein at least one is a liquid, comprising the following steps;

placing a disposable liquid resistant bag having an open top into an outer receptacle having an open top so that the bag nests in the outer receptacle, the outer receptacle has interior sidewalls that are inwardly sloping and adapted to contact the sidewalls of the disposable bag;

depositing the two components into the liquid resistant bag which is nested in the outer receptacle so that the sidewalls of the bag expand into contact with the inwardly sloping sidewalls of the outer receptacle;

placing a rotary mixing element of a rotary mixing means into the components located in the bag; and rotating the rotary mixing element mixing the components located in the bag.

15. A method of mixing at least two components as defined by claim 14 comprising the additional step of locating the rotary mixing element by a centering means so that it is located in the center of the bag.

16. A method of mixing at least two components as defined by claim 15 comprising the additional step of overlapping an extended portion of the bag so that it overlaps the top of the outer receptacle.

17. A method of mixing at least two components as defined by claim 16 comprising the additional step of dispensing the mixed components located in the bag.

18. A method of mixing at lest two components as defined by claim 17 wherein the step of dispensing comprises the additional substep of pushing a plunger formed by the bottom of the outer receptacle upwards towards the open top so as to dispense the mixed components located in the bag.

19. A method of mixing at least two components as defined by claim 17 comprising the additional step of measuring the volume of the components as they are placed in the bag by indicating indicia located on the outer receptacle.

* * * * *